US010285565B2

(12) United States Patent
Naik et al.

(10) Patent No.: US 10,285,565 B2
(45) Date of Patent: May 14, 2019

(54) UTENSIL RACK FOR A DISHWASHER

(71) Applicant: WHIRLPOOL CORPORATION, Benton Harbor, MI (US)

(72) Inventors: Sujit S. Naik, Pune (IN); Hrushikesh C. Prabhu, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/133,191

(22) Filed: Sep. 17, 2018

(65) Prior Publication Data

US 2019/0008357 A1 Jan. 10, 2019

Related U.S. Application Data

(63) Continuation of application No. 15/344,797, filed on Nov. 7, 2016, now Pat. No. 10,149,595.

(51) Int. Cl.
*A47L 15/50* (2006.01)
*A47L 19/04* (2006.01)

(52) U.S. Cl.
CPC ..... *A47L 15/501* (2013.01); *A47L 15/502* (2013.01); *A47L 15/506* (2013.01); *A47L 15/507* (2013.01); *A47L 19/04* (2013.01)

(58) Field of Classification Search
CPC .... A47L 15/502; A47L 15/505; A47L 15/504; A47L 15/50; A47L 15/503
See application file for complete search history.

(56) References Cited

U.S. PATENT DOCUMENTS

| | | | |
|---|---|---|---|
| 1,553,624 | A | 9/1925 | Merseles |
| 2,516,088 | A | 7/1950 | Einhom |
| 2,708,037 | A | 5/1955 | Planeta |
| 2,864,509 | A | 12/1958 | Watral |
| 2,885,087 | A | 5/1959 | Bliss |
| 4,046,261 | A | 9/1977 | Yake |
| D353,921 | S | 12/1994 | Lippisch et al. |
| 5,385,261 | A | 1/1995 | Lippisch et al. |
| 5,626,242 | A | 5/1997 | Weizer |
| 6,595,223 | B2 | 7/2003 | Wendt et al. |
| 7,228,975 | B2 | 6/2007 | Yang et al. |
| 7,493,905 | B2 | 2/2009 | Jeong et al. |
| 7,594,513 | B2 | 9/2009 | VanderRoest et al. |
| 8,746,467 | B2 | 6/2014 | Jeong |
| 8,794,455 | B2 | 8/2014 | Yang et al. |
| 9,119,493 | B2 | 9/2015 | Jeong |
| 9,265,404 | B2 | 2/2016 | Fey et al. |

(Continued)

FOREIGN PATENT DOCUMENTS

| | | | |
|---|---|---|---|
| CN | 104757926 | A | 7/2015 |
| DE | 19960264 | A1 | 6/2001 |

(Continued)

OTHER PUBLICATIONS

European Search Report for 17198683.9, dated Jan. 17, 2018.

*Primary Examiner* — Kimberley S Wright
(74) *Attorney, Agent, or Firm* — McGarry Bair PC

(57) ABSTRACT

A utensil rack for a dishwasher has a set of wave profiles. One subset of wave profiles has wave crests spaced from each other a first distance and a second set of wave profiles has wave crests spaced from each other a second distance less than the first distances. The utensil rack can be in the form of tray. A stemware section has one subset of wave profiles and a cutlery section has a second subset of wave profiles.

18 Claims, 6 Drawing Sheets

(56) References Cited

U.S. PATENT DOCUMENTS

| | | | |
|---|---|---|---|
| 9,510,729 | B2 | 12/2016 | Fey |
| 9,545,185 | B2 | 1/2017 | Lee et al. |
| 2002/0148493 | A1 | 10/2002 | Wendt et al. |
| 2004/0079713 | A1 | 4/2004 | Wendt et al. |
| 2005/0016941 | A1 | 1/2005 | Neff et al. |
| 2005/0241682 | A1 | 11/2005 | Jeong et al. |
| 2006/0243681 | A1 | 11/2006 | Bastuji et al. |
| 2008/0156358 | A1 | 7/2008 | Shin et al. |
| 2009/0038657 | A1 | 2/2009 | Kang |
| 2009/0090681 | A1 | 4/2009 | Graute |
| 2010/0117498 | A1 | 5/2010 | Leinmuller et al. |
| 2012/0181242 | A1 | 7/2012 | Jeong |
| 2014/0197719 | A1 | 7/2014 | Fey et al. |
| 2014/0239784 | A1 | 8/2014 | Jeong |
| 2015/0053238 | A1 | 2/2015 | Lee et al. |
| 2015/0320290 | A1 | 11/2015 | Hederstierna |
| 2015/0327749 | A1 | 11/2015 | Kaberg et al. |
| 2015/0335225 | A1 | 11/2015 | Seu |
| 2017/0280966 | A1 | 10/2017 | Kilic et al. |

FOREIGN PATENT DOCUMENTS

| | | | |
|---|---|---|---|
| EP | 1985223 | A1 | 10/2008 |
| JP | 2014076138 | A | 5/2014 |

UTENSIL RACK FOR A DISHWASHER

CROSS-REFERENCE TO RELATED APPLICATIONS

This application claims the benefit of and is a continuation of U.S. patent application Ser. No. 15/344,797, entitled "Utensil Rack For A Dishwasher," filed Nov. 7, 2016, now U.S. Pat. No. 10,149,595 issued Dec. 11, 2018, which is incorporated herein by reference in its entirety.

BACKGROUND OF THE INVENTION

Contemporary automatic dishwashers for use in a typical household include a tub defining a treating chamber and a spraying system for recirculating liquid throughout the tub to remove soils from dishes and utensils. Upper and lower dishracks for holding dishes to be cleaned are typically provided within the treating chamber. Dishwashers can also comprise an additional, slimmer, rack specifically for utensils, which is typically located above the upper dishrack. A utensil rack can comprise portions designed to hold utensils such as knives, spoons, forks, and spatulas as well as smaller objects that might fall through the dishracks during a cleaning cycle.

BRIEF DESCRIPTION OF THE INVENTION

In one aspect, a utensil rack for a dishwasher comprising: sidewalls forming a periphery for the utensil rack, with the sidewalls arranged in a first set of opposing sidewalls and a second set of opposing sidewalls; a lattice structure formed within the periphery by a first set of ribs, extending between the first set of opposing sidewalls, and a second set of ribs, extending between the second set of opposing sidewalls, and crossing the first set of ribs; a stemware section comprising a first set of wave profiles comprising at least a first pair of waves spaced from each other a first distance, with the first pair of waves connected to and extending upwardly from one of the first or second set of ribs, with the first pair of waves having at least two crests and an intervening trough; and a cutlery section comprising a second set of wave profiles comprising at least a second pair of waves spaced from each other a second distance, with the second pair of waves connected to and extending upwardly from one of the first or second set of ribs, with the second pair of waves having at least two crests and an intervening trough, with the second distance being less than the first distance.

DESCRIPTION OF EMBODIMENTS OF THE INVENTION

Figure 1:
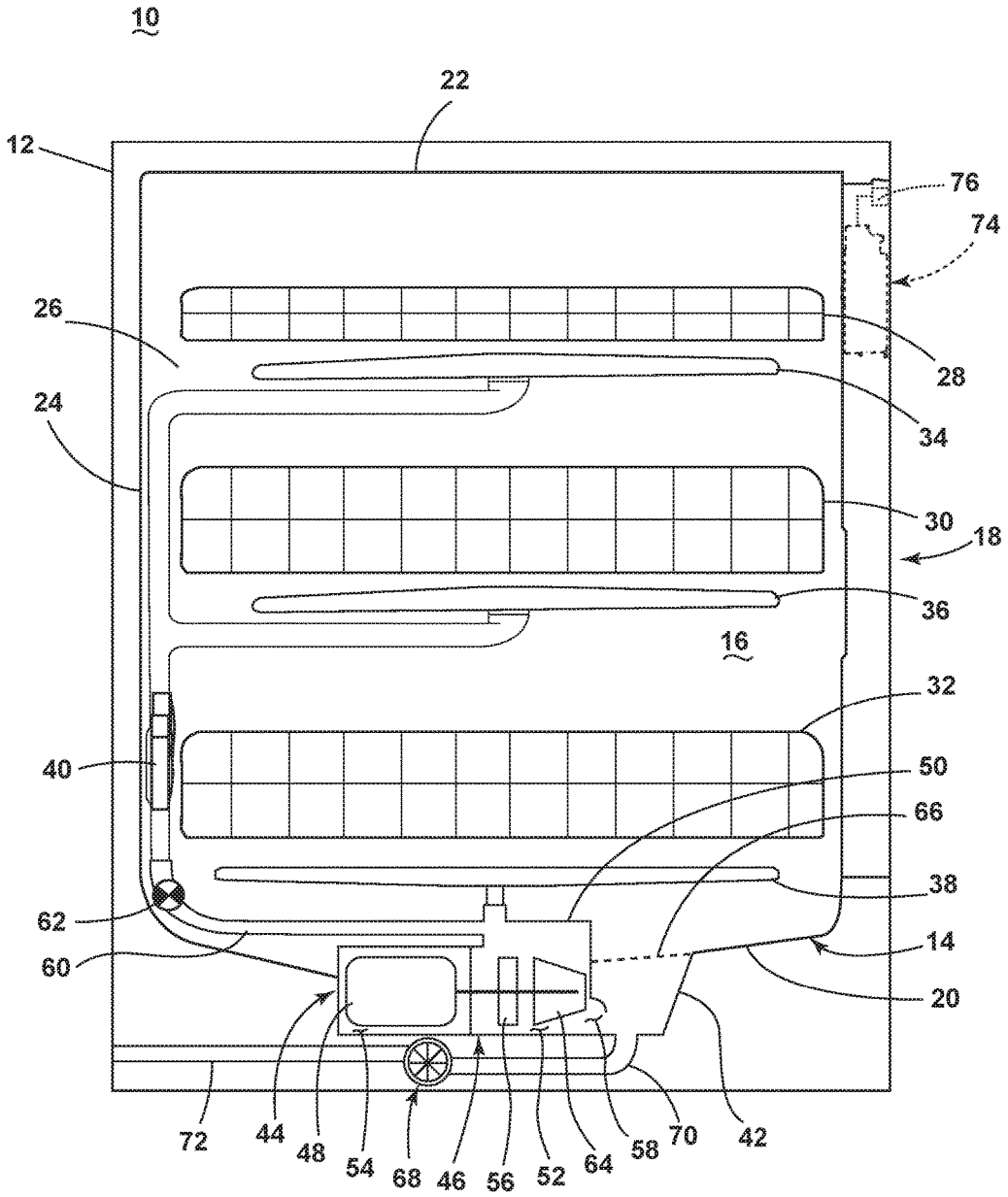
FIG. 1 is a schematic, cross-sectional view of a dishwasher of the where the invention can be implemented.

FIG. 1 is a schematic view of an example automatic dishwasher 10 where the invention may be implemented.

The dishwasher 10 can treat dishes according to an automatic cycle of operation. Depending on whether the dishwasher 10 is a stand-alone or built-in, the dishwasher includes a cabinet 12 that may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

An open-faced tub 14 is within the cabinet 12 and may at least partially define a treating chamber 16, having an open face, for washing dishes. A closure element, such as a door assembly 18, may be movably mounted to the dishwasher 10 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 may be secured to the lower front edge of the cabinet 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open. Alternatively, the closure element may be slidable relative to the cabinet 12, such as in a drawer-type dishwasher, wherein the access opening for the treating chamber 16 is formed by an open-top tub. Other configurations of the closure element relative to the cabinet 12 and the tub 14 are also within the scope of the invention.

The tub 14 includes a bottom wall 20 and a top wall 22, with a rear wall 24 joining the bottom and top walls 20, 22, and two side walls 26 joining the bottom and top walls 20, 22 and extending from the rear wall 24 toward the open face of the tub 14. When the door assembly 18 is closed, the door assembly 18 effectively forms a front wall of the tub 14 to enclose the treating chamber 16.

Dish holders, illustrated in the form of upper, middle, and lower dishracks 28, 30, 32, may be located within the treating chamber 16 and receive dishes for treatment, such as washing. The upper, middle, and lower racks 28, 30, 32 are typically mounted for slidable movement in and out of the treating chamber 16 for ease of loading and unloading. The upper rack 28 may be in the form of a utensil rack, an example of which is disclosed herein. Other utensil racks as disclosed herein may be used, separate from or combined with the upper, middle, and lower racks 28, 30, 32. As used in this description, the term "dish(es)" is intended to be generic to any item, single or plural, that may be treated in the dishwasher 10, including, without limitation, dishes, plates, pots, bowls, pans, glassware, knives, spoons, forks, or any other washable item. "Utensils" is intended to be generic to useful tools and implements, such as those used to prepare, serve, and eat food. "Cutlery" is a subset of utensils that identifies cutting utensil, especially knives and the like. It is also possible for the treating chamber 16 to comprise only a middle and lower rack 30, 32.

A spray system may be provided for spraying liquid in the treating chamber 16 and may be provided in the form of, for example, an upper spray assembly 34, a middle spray assembly 36, and a lower spray assembly 38. The upper spray assembly 34, the middle spray assembly 36, and the lower spray assembly 38 are located, respectively, beneath the upper rack 28, beneath the middle rack 30, and beneath the lower rack 32 and are illustrated as rotating spray arms by example but are not limited to such positions and sprayer type. The spray system may further include an additional spray assembly 40. For example, a distribution header or spray manifold may be located at the rear of the tub 14 at any vertical position. The spray system may also comprise only a middle spray assembly 36 and a lower spray assembly 38, or any other suitable combination of spray assemblies. An exemplary spray manifold is set forth in detail in U.S. Pat. No. 7,594,513, issued Sep. 29, 2009, and titled "Multiple Wash Zone Dishwasher," which is incorporated herein by reference in its entirety. The illustrated additional spray assembly 40 is illustrated as being located adjacent the lower dishrack 32 along the rear wall 24 of the treating chamber 16.

A recirculation system may be provided for recirculating liquid from the treating chamber 16 to the spray system. The recirculation system may include a sump 42 and a pump assembly 44. The sump 42 collects the liquid sprayed in the treating chamber 16 and may be formed by a sloped or recessed portion of the bottom wall 20 of the tub 14, or may be separate from the bottom wall 20. The pump assembly 44 may include a recirculation pump 46 fluidly coupling the treating chamber 16 to the liquid spraying system and a motor 48 drivingly coupled to the recirculation pump 46. The recirculation pump 46 and motor 48 may be enclosed within a housing 50 having a pump chamber 52 and a motor chamber 54, respectively. The recirculation pump 46 includes an impeller 56 within the pump chamber 52 in fluid communication with the sump 42 via an inlet 58. The lower portion of the housing 50 defining the pump chamber 52 may define a portion of the sump 42 or a remote sump that is coupled to the treating chamber 16 to collect liquid and soil particles via the inlet 58.

During a wash or recirculation cycle, the impeller 56, driven by the motor 48, may draw liquid from the sump 42 through the inlet 58, and the liquid may be simultaneously or selectively pumped through a supply conduit 60 to each of the spray assemblies 34, 36, 38, 40 for selective spraying. A diverter 62 may be provided within a portion of the supply conduit 60 for selectively controlling the supply of liquid to one or more of the spray assemblies 34, 36, 38, 40 at a time. As such, downstream of the diverter, the supply conduit 60 may branch into multiple conduits, each supplying at least one of the spray assemblies 34, 36, 38, 40. While not shown, a liquid supply system may include a water supply conduit coupled with a household water supply for supplying water to the treating chamber 16.

A filter assembly 64 may be provided between the sump 42 and impeller 56 for allowing soils of only a predetermined size into the impeller 56. In some embodiments, the filter assembly 64 may include a rotatable filter provided within the pump chamber 52 and driven by the motor 48 for rotation with the impeller 56. In other embodiments, the filter assembly 64 may be non-rotatable. Other apparatus for filtering the wash liquid may also be provided in addition to or instead of the filter assembly 64. In one non-limiting example, a coarse screen filter 66 may be provided at the bottom wall 20 of the tub 14 to prevent large objects or soils from entering the sump 42.

The rotational axes of the motor 48, impeller 56, and filter assembly 64 are illustrated herein as being horizontally-oriented, with respect to the normal operational position of the dishwasher 10. In other embodiments of the invention, the rotational axes of the motor 48, impeller 56, and/or filter assembly 64 may be vertically-oriented, or at an oblique angle between horizontal and vertical.

The pump assembly 44 may further include a drain pump 68. The drain pump 68 may be driven by a separate motor (not shown) or by the motor 48 for the recirculation pump 46, and may draw liquid from the sump 42, through a sump outlet conduit 70, and pump the liquid out of the dishwasher 10 to a household drain line (not shown) via, for example, a drain conduit 72.

In accordance with one aspect of the present invention, at least a portion of the pump assembly 44 can be located above the bottom wall 20 of the tub 14. By having the pump assembly 44 at least partially above the bottom wall 20, the bottom wall 20 can be lowered closer to the bottom of the cabinet 12 or the floor on which the dishwasher rests. Thus, the distance between the bottom wall 20 and the top wall 22 can be increased, which increases the overall capacity of the tub 14, which may be defined by the volume of the treating chamber 16 or by the number of items that can be received by the dishracks 28, 30, 32. This can also more than offset any capacity potentially lost by the placement of the pump assembly 44 partially above the bottom wall 20, so that an overall capacity increase is still gained in comparison to a dishwasher which positions the entire pump assembly below the bottom wall.

As shown, the bottom wall 20 is sloped downwardly toward the sump 42. In other embodiments, the bottom wall 20 can be flat. The bottom wall 20 can terminate at the junction with the sump 42 and the pump assembly 44, with the sump extending below the bottom wall 20 and at least a portion of the pump assembly 44 extending above the bottom wall 20. In some embodiments the portion of the pump assembly 44 may extend above the entire bottom wall 20, and in other embodiments the portion of the pump assembly 44 may extend above the portion of the bottom wall 20 that meets the pump assembly 44.

As shown, a portion of the recirculation pump 46 and the motor 48 are located above the bottom wall 20 of the tub 14. Portions of the recirculation pump 46 and the motor 48 are also located beneath the bottom wall 20. In addition, the filter assembly 64 is also partially located above the bottom wall 20. The drain pump 68 is shown as located fully beneath the bottom wall 20 of the tub 14, but in other embodiments of the invention the drain pump 68 may also be located at least partially above the bottom wall 20. The diverter 62 is shown as located fully above the bottom wall 20 of the tub 14, but in other embodiments of the invention the diverter 62 may also be located at least partially below the bottom wall 20.

A control system including a controller 74 may also be included in the dishwasher 10, which may be operably coupled with various components of the dishwasher 10 to implement a cycle of operation. The controller 74 may be located within the door assembly 18 as illustrated, or it may alternatively be located somewhere within the cabinet 12. The controller 74 may also be operably coupled with a control panel or user interface 76 for receiving user-selected inputs and communicating information to the user. The user interface 76 may include operational controls such as dials, lights, switches, and displays enabling a user to input commands, such as a cycle of operation, to the controller 74 and receive information.

Figure 2:
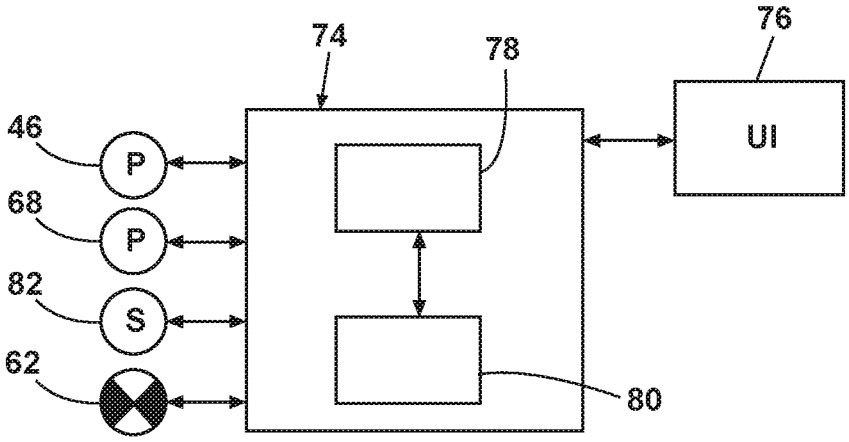
FIG. 2 is a schematic view of a controller of the dishwasher of FIG. 1.

As illustrated schematically in FIG. 2, the controller 74 may be coupled with the recirculation pump 46 for recirculating the wash liquid during the cycle of operation, the drain pump 68 for draining liquid from the treating chamber 16, and the diverter 62 for controlling the supply of liquid to one or more of the spray assemblies 34, 36, 38, 40 at a time. The controller 74 may be provided with a memory 78 and a central processing unit (CPU) or processor 80. The memory 78 may be used for storing control software that may be executed by the processor 80 in completing a cycle of operation using the dishwasher 10 and any additional software. For example, the memory 78 may store one or more pre-programmed cycles of operation that may be selected by a user and completed by the dishwasher 10. The controller 74 may also receive input from one or more sensors 82. Non-limiting examples of sensors that may be communicably coupled with the controller 74 include a temperature sensor and turbidity sensor to determine the soil load associated with a selected grouping of dishes, such as the dishes associated with a particular area of the treating chamber 16.

The memory 78 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s). The processor 80 can be implemented by, for example, one or more Atmel®, Intel®, AMD®, and/or ARM® microprocessors. Of course, other processors from other processor families and/or manufacturers are also appropriate.

Figure 3:
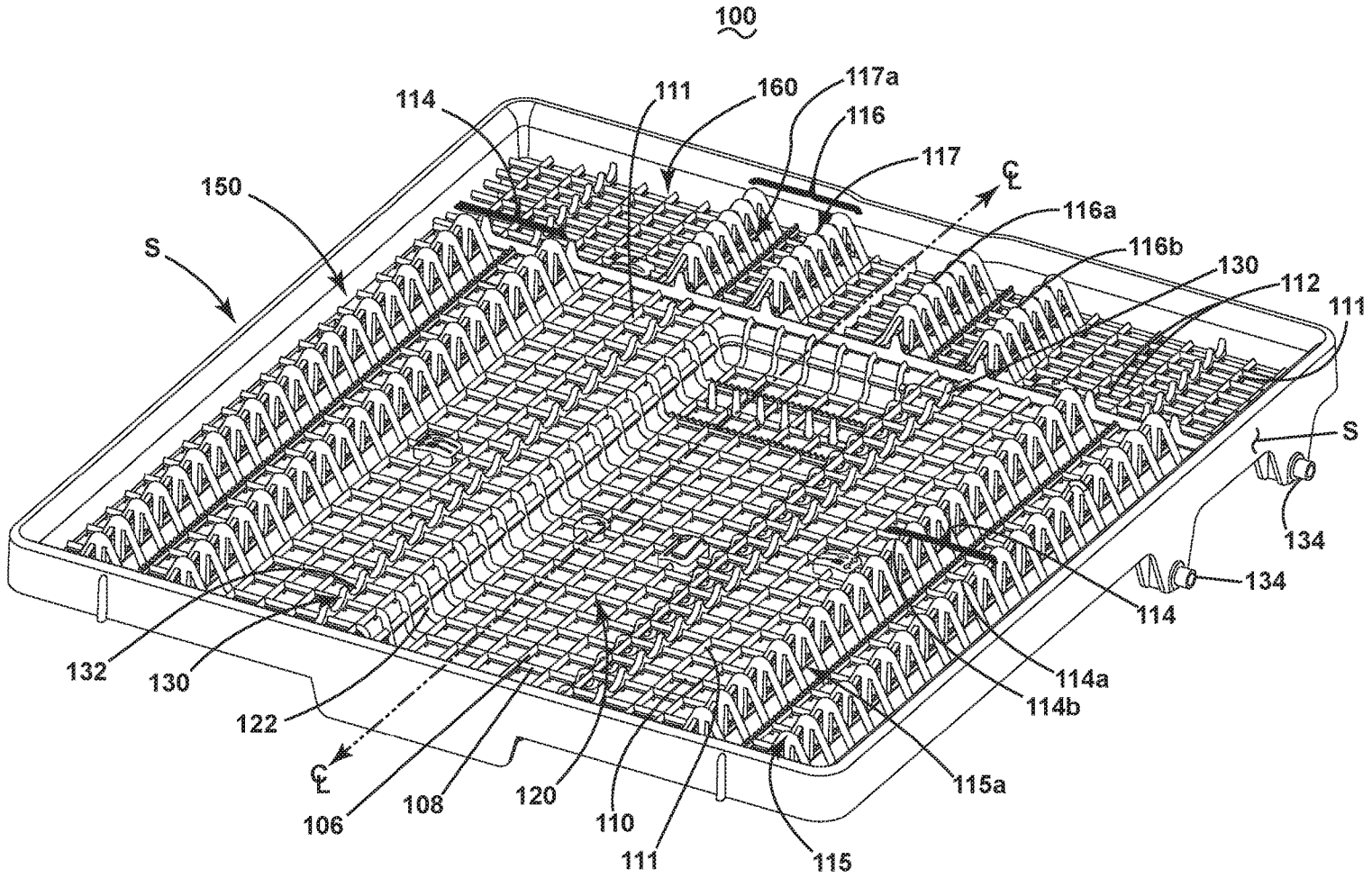
FIG. 3 is a perspective view of a utensil rack according to an embodiment of the invention.

FIG. 3 illustrates perspective view of a utensil rack 100 according to an embodiment of the invention. The utensil rack 100 can be slidably attached to the dishwasher 10, replacing, for example the upper dishrack 28 of FIG. 1. The utensil rack 100 can comprise rollers disposed within a rail attached to a dishwasher to render the utensil rack 100 slidable relative to the dishwasher 10. Axles 134 can be mounted within the rollers; however any suitable method to couple the utensil rack 100 to the tub 14 can be used.

The utensil rack 100 can comprise horizontal rack lines 110, 112, cross lines 111, sets of wave profiles 114, 116, and stem profiles 130. Cross lines 111 cross the horizontal rack lines 110 and 112 and form a lattice structure. The horizontal rack lines 110 and 112 and cross lines 111 are spaced in order to allow wash liquid to reach the utensils and to support utensils from falling through the utensil rack 100. The horizontal rack lines 110 and 112 connect to sets of wave profiles 114 and 116, respectively. The horizontal rack lines 110 and 112 also connect to stem profiles 130. Any or all of the horizontal rack lines 110, 112, cross lines 111, sets of wave profiles 114, 116, and stem profiles 130 may be formed of coated wires, molded or injected plastics, or like materials.

Four sets of wave profiles 114 and 116 are shown, each of two sets having waves 114*a*, 114*b*, and 116*a*, 116*b*, respectively. Each set of wave profiles 114 or 116 thus has a pair of waves 114*a*, 114*b*, or 116*a*, 116*b* comprising crests 115 or 117 and troughs 115*a* or 117*a* between the crests 115 and 117, respectively. While two waves are shown per set of wave profiles, it is within the scope of the invention for the sets of wave profiles 114 and 116 to comprise more than two waves, or only one wave. A first subset of wave profiles 114 forms a stemware section 150 and a second subset of wave profiles 116 forms a cutlery section 160. FIG. 3 shows two first subsets of wave profiles 114 each disposed closer to a side, S, of the utensil rack 100 while two second subsets of wave profiles 116 are separated from the first subsets of wave profiles 114 and each is disposed closer to the centerline CL than the first subsets of wave profiles 114. Alternate locations for the subsets of wave profiles 114 or 116 are also within the scope of the invention. For example, one first subset of wave profiles 114 and one second set of wave profiles 116 can be on each side of the centerline CL, wherein the first subset of wave profiles 114 and the second set of wave profiles 116 are both oriented towards the centerline CL.

Stem profiles 130 are parallel to and spaced apart from the sets of wave profiles 114 and 116. The stem profiles comprise troughs 132 which provide support for an end portion of a utensil in between horizontal rack lines 110 or 112. The stem profiles 130 cross horizontal rack lines 110, 112 similarly to the way cross lines 111 cross the horizontal rack lines 110, 112 to form a lattice structure. In the event that a first subset of wave profiles 114 is closer to one side, S, of the utensil rack 100, the corresponding stem profiles 130 will be spaced closer to the centerline CL than the first subset of wave profiles 114. In the event that a second subset of wave profiles 116 is disposed closer to the centerline CL, the corresponding stem profiles 130 will be spaced further away from the center line CL than the second subset of wave profiles 116.

The utensil rack 100 also comprises vertical portions 122 that have a downward slope from the horizontal rack lines 110. The vertical portions 122 connect to the lattice structure formed by horizontal rack lines 108 and cross lines 106, which collectively form a recessed area 120.

Figure 4:
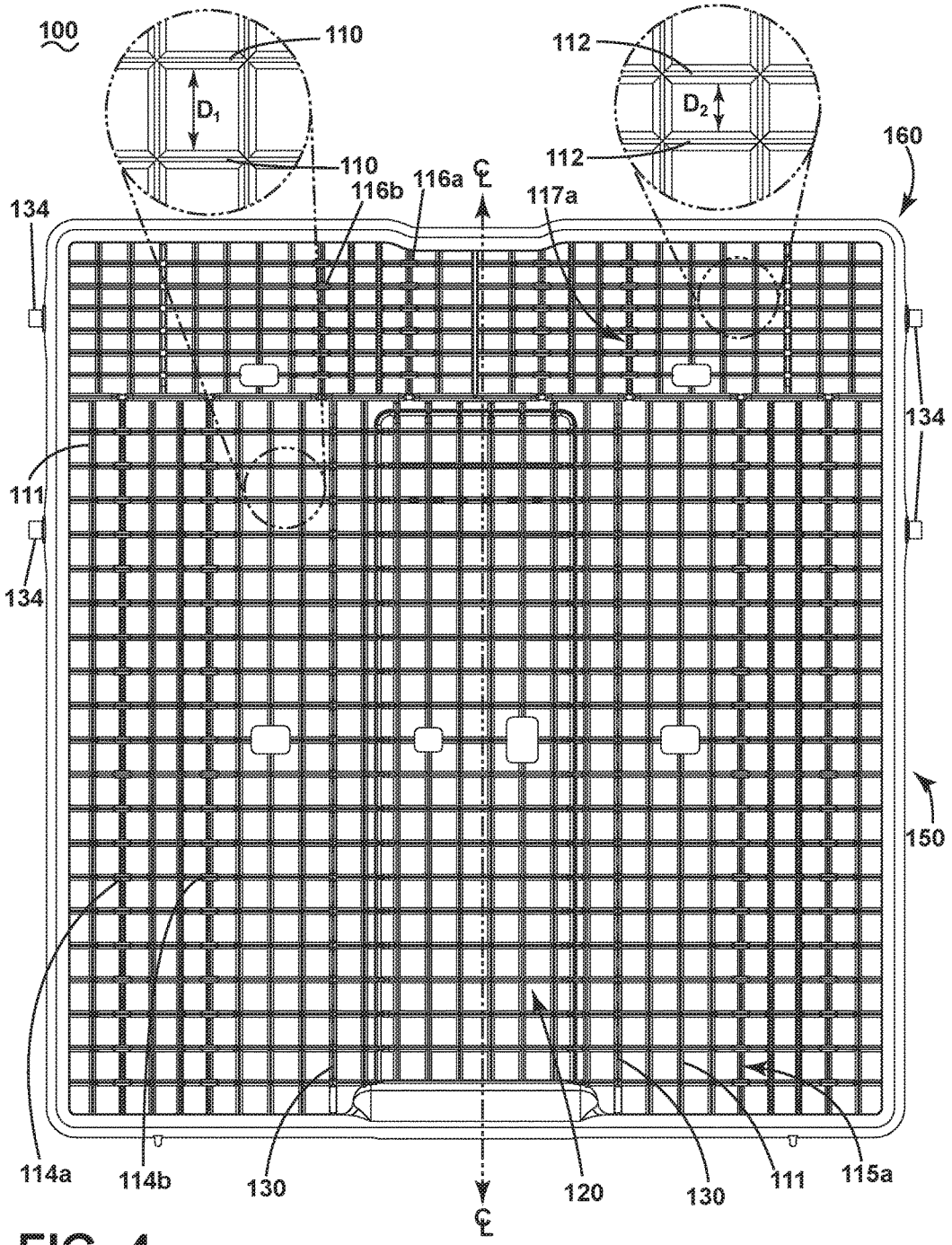
FIG. 4 is a top view of the utensil rack of FIG. 3.

FIG. 4 illustrates a top view of a utensil rack according to an embodiment of the invention. Here, the spacing between horizontal rack lines 110 and 112 is shown more clearly. The distance between horizontal rack lines 110 is represented by a first distance $D_1$, while the distance between horizontal rack lines 112 is represented by a second distance $D_2$. Horizontal rack lines 112 are spaced closer together than horizontal rack lines 110, therefore $D_2$is less than $D_1$. Distance $D_1$ illustrates the distance between wave crests 115, while distance $D_2$ illustrates the distance between wave crests 117. Thus, wave crests 117 are spaced at less of a distance than wave crests 115. Stated in another way, distance $D_1$ illustrates the length of trough 115*a* and distance $D_2$ illustrates the length of trough 117*a*. Distance $D_1$ is dimensioned to receive and separate stemware dropped onto wave crests 115, or the first subset of wave profiles 114. Distance $D_2$ is dimensioned to receive individual blades of cutlery placed between wave crests 117, or within troughs 117*a*.

Figure 5:
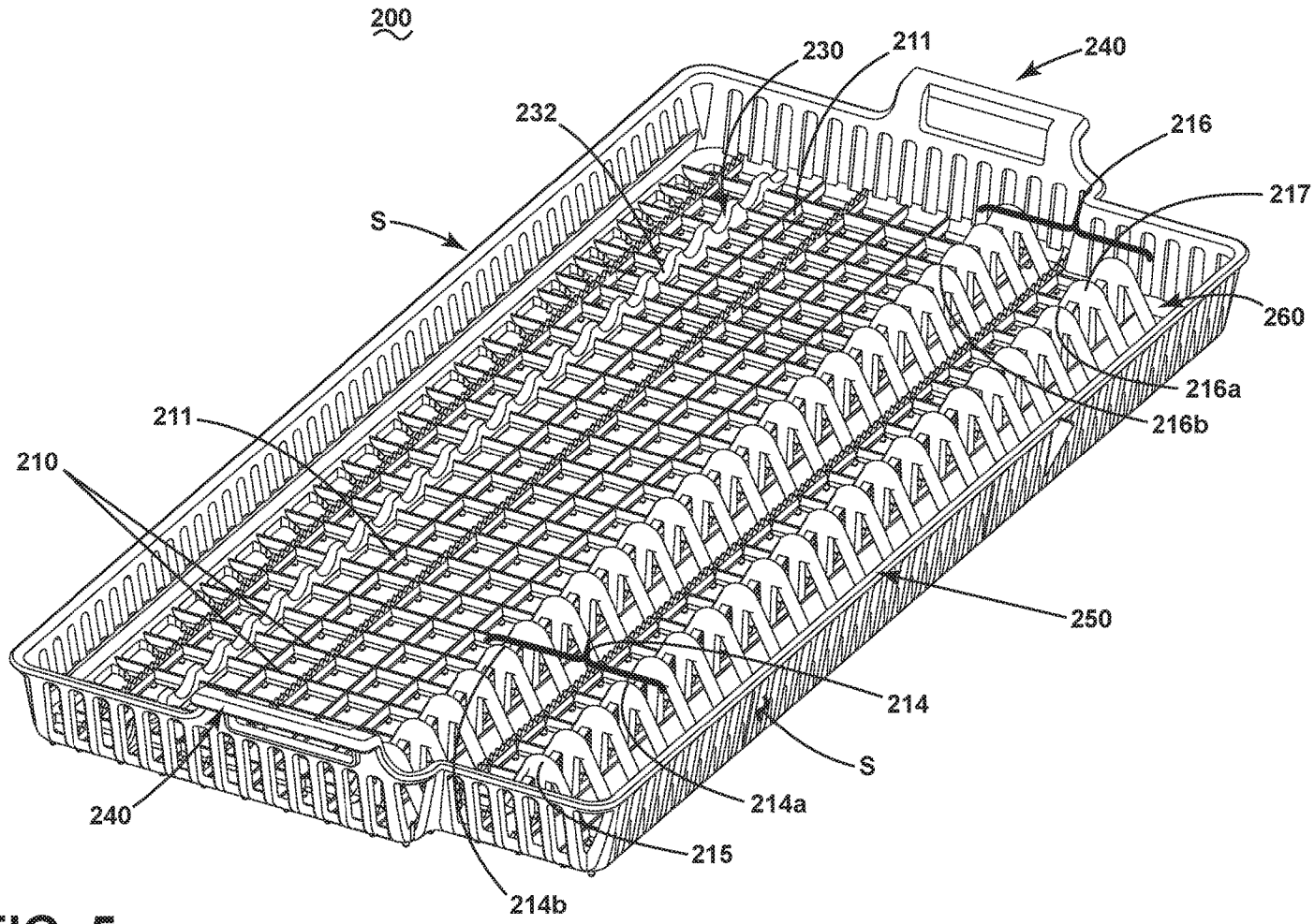
FIG. 5 is a perspective view of a removable utensil rack according to an embodiment of the invention.

FIG. 5 is perspective view of a removable utensil rack 200 in the form of a tray according to a second embodiment of the invention. The removable utensil rack 200 can be removable from a dishrack attached to the dishwasher 10. Handles 240 can be formed to fit onto the dishrack and facilitate removal of the removable utensil rack 200 from the dishrack. The second embodiment is similar to the first embodiment, with the primary differences being the second embodiment is a removable rack, rather than a permanent rack, and the removable rack 200 is less wide than the utensil rack 100. For the most part, like parts between the two embodiments will be identified with like numerals, with the numerals of the second embodiment having the 200 prefix, unless otherwise noted.

In this embodiment, first and second subsets of wave profiles 214 and 216 also form a stemware section 250 and a cutlery section 260, respectively. However, FIG. 5 illustrates the stemware section 250 and the cutlery section 260 aligned, thus the first and second subsets of wave profiles 214 and 216 are in a single set of wave profiles. It is also possible that the stemware section 250 and the cutlery section 260 are not aligned and are separated. For example, the stemware section 250 can be closer to one side, S, of the removable utensil rack 200 while the cutlery section 260 can be closer to another side, S, of the removable utensil rack 200.

Figure 6:
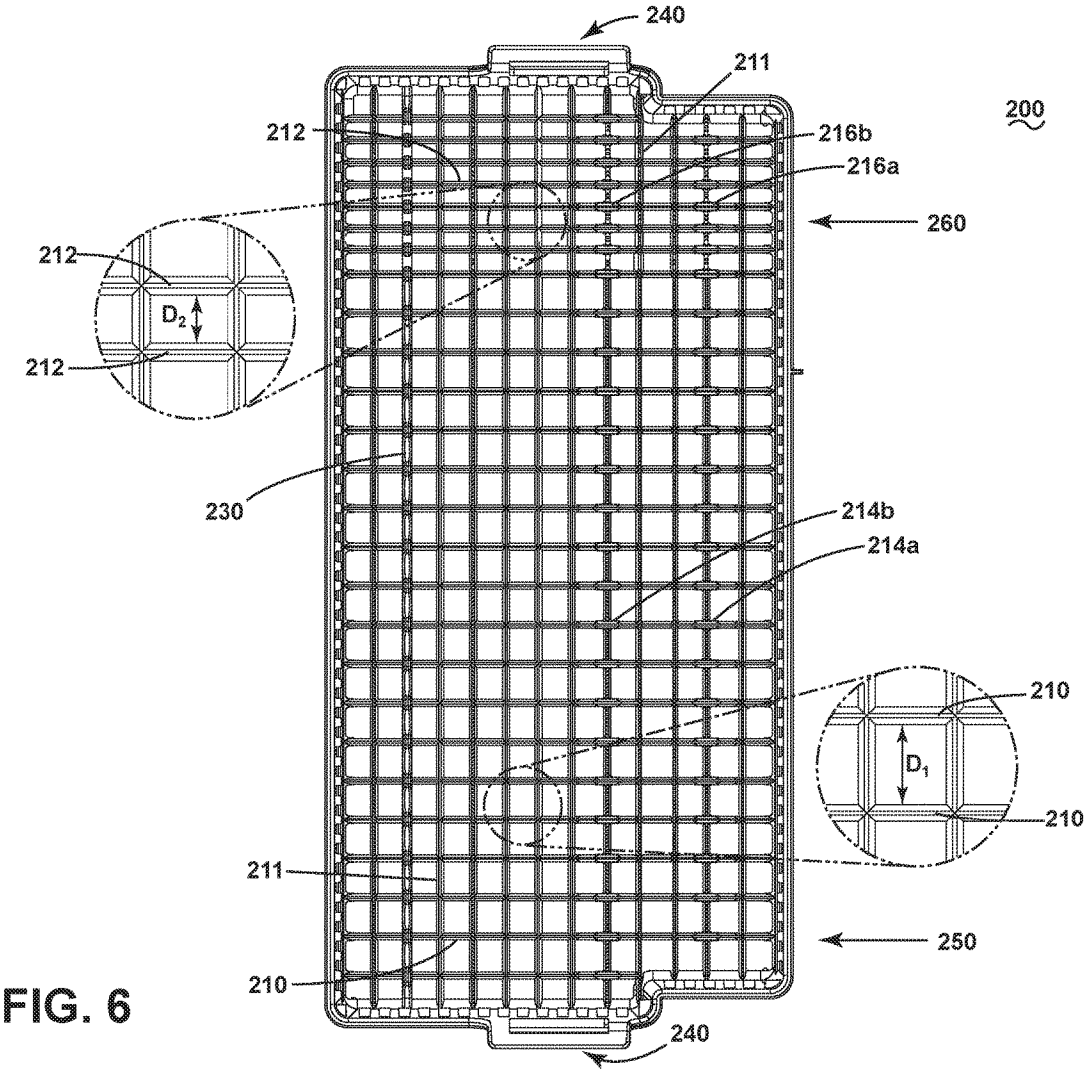
FIG. 6 is a top view of the removable utensil rack of FIG. 5.

FIG. 6 is a top view of the removable utensil rack 200. Here, the spacing between horizontal rack lines 210 and 212 is shown more clearly. The distance between horizontal rack lines 210 is represented by first distance $D_1$, while a second distance between horizontal rack lines 212 is represented by $D_2$. Horizontal rack lines 212 are spaced closer together than horizontal rack lines 210, therefore $D_2$ is less than $D_1$.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A utensil rack for a dishwasher comprising:

sidewalls forming a periphery for the utensil rack, with the sidewalls arranged in a first set of opposing sidewalls and a second set of opposing sidewalls;

a lattice structure formed within the periphery by a first set of ribs, extending between the first set of opposing sidewalls, and a second set of ribs, extending between the second set of opposing sidewalls, and crossing the first set of ribs;

a stemware section comprising a first set of wave profiles comprising at least a first pair of waves spaced from each other a first distance, with the first pair of waves connected to and extending upwardly from one of the first or second set of ribs, with the first pair of waves having at least two crests and an intervening trough; and a cutlery section comprising a second set of wave profiles comprising at least a second pair of waves spaced from each other a second distance, with the second pair of waves connected to and extending upwardly from one of the first or second set of ribs, with the second pair of waves having at least two crests and an intervening trough, with the second distance being less than the first distance.

2. The utensil rack of claim 1 wherein the utensil rack has a centerline.

3. The utensil rack of claim 2 wherein the stemware section and the cutlery section are on the same side of the centerline.

4. The utensil rack of claim 2 wherein the stemware section and the cutlery section are on the opposite sides of the centerline.

5. The utensil rack of claim 2 wherein at least one of the stemware section or the cutlery section spans the centerline.

6. The utensil rack of claim 2 wherein one of the stemware section or the cutlery section spans the centerline and the other of the stemware section or cutlery section does not span the centerline.

7. The utensil rack of claim 1 wherein the first distance is dimensioned to receive and separate stemware dropped onto the first pair of waves and the second distance is dimensioned to receive individual blades of cutlery placed therein.

8. The utensil rack of claim 1 further comprising handles to facilitate removal of the rack from a dishrack.

9. The utensil rack of claim 1 further comprising rollers disposed within a rail attached to the dishwasher to render the utensil rack slidable relative to the dishwasher.

10. The utensil rack of claim 1 wherein the stemware section and the cutlery sections are aligned.

11. The utensil rack of claim 1 wherein the stemware section and the cutlery sections are separated from each other.

12. The utensil rack of claim 1 wherein the stemware section is closer to one side of the utensil rack than the cutlery section.

13. The utensil rack of claim 1 wherein the utensil rack is removable from a dishrack attached to the dishwasher.

14. The utensil rack of claim 1 wherein the utensil rack is slidably attached to the dishwasher.

15. The utensil rack of claim 1 further comprising a set of stem profiles spaced from either the first or second set of wave profiles in the first direction.

16. The utensil rack of claim 2 further comprising a set of stem profiles spaced in the first direction from each set of wave profiles.

17. The utensil rack of claim 16 wherein the stem profiles parallel to the second set of wave profiles are spaced further away from the centerline than the second set of wave profiles and the stem profiles parallel to the first set of wave profiles are spaced closer to the centerline than the first set of wave profiles.

18. The utensil rack of claim 17 further comprising a recessed area between the two first sets of wave profiles.

* * * * *